US006296253B1

(12) United States Patent
Waychoff

(10) Patent No.: US 6,296,253 B1
(45) Date of Patent: Oct. 2, 2001

(54) METHOD OF PLAYING GAME USING PLAYING CARDS, GRAB ITEMS AND BODY APPENDAGES

(76) Inventor: Challen W. Waychoff, 58 Knox La., Wheeling, WV (US) 26003

( * ) Notice: Subject to any disclaimer, the term of this patent is extended or adjusted under 35 U.S.C. 154(b) by 0 days.

(21) Appl. No.: 09/527,536

(22) Filed: Mar. 16, 2000

Related U.S. Application Data

(62) Division of application No. 08/976,500, filed on Nov. 24, 1997, now Pat. No. 6,053,498.

(51) Int. Cl.[7] ..... A63B 67/00
(52) U.S. Cl. ..... 273/447; 273/292; 273/444
(58) Field of Search ..... 273/292, 303, 273/304, 308, 444, 445, DIG. 17, 18, 19, 447

(56) References Cited

U.S. PATENT DOCUMENTS

| | | | |
|---|---|---|---|
| 832,005 | | 9/1906 | Atkinson . |
| 1,060,900 | | 5/1913 | Hobbs . |
| 1,583,223 | | 5/1926 | Cooke . |
| 3,159,403 | | 12/1964 | Glass et al. . |
| 3,524,645 | | 8/1970 | Breslow . |
| 4,327,911 | | 5/1982 | Ptaszek et al. . |
| 4,773,643 | * | 9/1988 | Mizunuma . |
| 4,993,717 | * | 2/1991 | Fiske . |

OTHER PUBLICATIONS

Scarne's encyclopedia of games "Donkey and PIG" p. 362–363.*
See attached Scane's encyclopedia of genes pp. 362–363, 1973.

* cited by examiner

*Primary Examiner*—Benjamin H. Layno
*Assistant Examiner*—V K Mendiratta
(74) *Attorney, Agent, or Firm*—Rothwell, Figg, Ernst & Manbeck

(57) ABSTRACT

A unique game involving card playing, quickness, and costumery. The game combines elements of the card game "Fish" in that part of the object is to accumulate a complete set of like cards. The game also incorporates aspects similar to "Musical Chairs" in that when a certain event occurs, e.g., when one of the players accumulates a complete set of like card, all of the players grab for a grab item. With one less grab item being available than the number of players, one of the players will not get one. Players unable to grab a grab item are penalized by sequentially being required to put on and wear funny items such as fake pig's noses and ears.

15 Claims, 1 Drawing Sheet

FIGURE
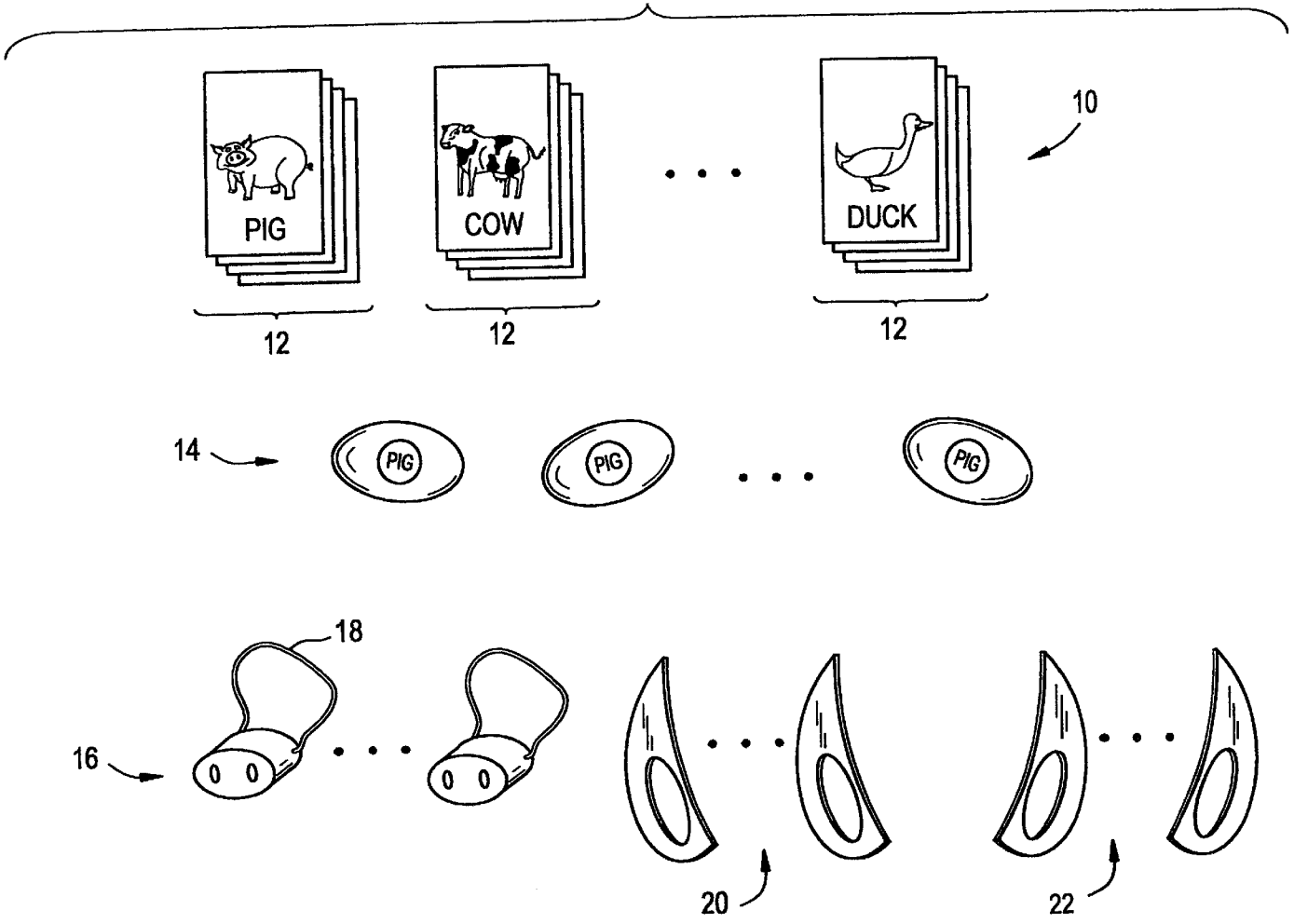

METHOD OF PLAYING GAME USING PLAYING CARDS, GRAB ITEMS AND BODY APPENDAGES

This application is a Division of Ser. No. 08/976,500, filed Nov. 24,1997 now U.S. Pat. No. 6,053,498.

BACKGROUND OF THE INVENTION

1. Field of the Invention

The invention relates generally to a game useful for entertainment. In particular, the invention relates to a game using cards, moveable grab items, and animal appendages that can be placed upon and worn by the players.

2. Description of the Background Art

Numerous games have been developed to facilitate enjoyment. One such game is disclosed in U.S. Pat. No. 1,060,900. The U.S. Pat. No. 1,060,900 patent discloses a game which utilizes cards with pictures of different animals. Another such game is disclosed in U.S. Pat. No. 3,524,645. The U.S. Pat. No. 3,524,645 patent discloses the use of a card holding apparatus, which is configured to be worn on a player's forehead, in combination with a deck of playing cards. A third game is disclosed in U.S. Pat. 3,159,403. The U.S. Pat. No. 3,159,403 patent discloses the use of individually movable playing pieces that are configured to be stacked upon one another.

SUMMARY OF THE INVENTION

The present invention is a multi-faceted game which combines card-playing skills, quickness, and costumery into one game. In particular, the apparatus for playing the game according to the invention includes a deck of game cards, a number of grab items, and a number of sets of items to be placed on the body and worn as a penalty, one item at a time until being eliminated from the game. The cards are marked with indica and are subdivided into groups with the cards in a given group each bearing the same indicia.

In preferred embodiments, the indicia on the cards are farm animals, and the items put on and worn upon the body are animal appendages, e.g., a pig nose and ears.

To play the game, the cards are distributed among the players and are passed between the players until one of the players accumulates all of the cards of a given group. At that point, the player who has accumulated all of the cards in a given a group grabs for one of the grab items, and the other players grab for one of the grab items as well. Because the number of grab items used is one less than the number of players playing the game, one of the players will not be able to grab a grab item and that player is "penalized" by being required to put on and wear one of the costume items. Play is then repeated until a player has accumulated a predetermined number of the costume items, at which point that player is out of the game. The number of grab items available to be grabbed is then reduced by one, and preferably the number of groups of cards present in the deck of cards being used—preferably equal to the number of players playing at a given point in time—is also reduced by one.

Thus, in one aspect, the invention provides a method of playing a game in which a number of hand-grabbable grab items are placed where they can be reached by all players, with the number of grab items present being one less than the number of players playing the game. Upon the occurrence of a predetermined event, each of the players tries to grab one of the grab items, with all but one of the players actually being able to grab a grab item. The player that is not able to grab a grab item is assigned a penalty, the penalty being that that player has to put on and wear a wearable item, i.e., a piece of the costume.

In another aspect, the invention is a method of playing a game in which a number of hand-grabbable items are placed where they can be reached by all of the players, there being one less grab item available than the number of players present. A deck of game cards is provided, with the deck being subdivided into groups of game cards wherein each of the game cards in a given group bears the same indicia. The players pass the game cards among themselves until one of the players has all of the game cards in a given group, at which point, that player reaches for one of the grab items. At this point, all of the other players try to grab one of the grab items, with all but one of the players being able to grab one. The player unable to grab a grab item is assigned a penalty.

In preferred embodiments of the invention according to either of these two aspects, the penalty consists of being required to put on and wear replicas of animal appendages, e.g., a pig nose and pig ears. When a player accumulates a predetermined number of penalties, e.g., the player has been required to put on and wear all of the pig appendages, that player is eliminated and the game continues with one less grab item being made available. Play continues in this manner until two players remain, at which point the player of the two having the lesser number of penalties is declared the winner in an interesting way of playing the game under either of these two aspects, a player may pretend that the predetermined event, e.g., the collection of all the cards in a group, has occurred and fake a grab for one of the grab items. The first of any players to be fooled by such a fake is then penalized appropriately.

BRIEF DESCRIPTION OF THE DRAWING

The preferred embodiment contemplated for practicing the present invention will now be described in detail in conjunction with the drawing, which is a schematic view of the game pieces of the invention.

DESCRIPTION OF THE PREFERRED EMBODIMENT

As shown in the drawing, a game set according to the preferred embodiment of the invention includes a deck of fifty-two playing cards 10 with animals on one side and a decorative backing on the other side. The cards are grouped in sets 12 of four cards each, the cards in each set depicting the same farm animal and there being thirteen different animals depicted altogether. Twelve "grab items"14, preferably thick and smooth like wooden "stones" or even spoons with a PIG emblem emblazoned thereon, are provided. Thirteen pig noses 16, which are fastened abound the players' heads and over their noses with elastic bands 18, thirteen right pig ears 20, and thirteen left pig ears 22 which fit over the players' ears are also provided.

The game is played as follows. The grab items 14 are placed in the center of a playing surface, with one less grab item than the number of players present being used. For example, if there are eight players, seven grab items are placed in the center of the playing surface.

The playing cards 10 are separated into the groups 12 of four of a kind, such as four ducks, four chickens, and so on until all of the animals are matched. In each game, there shall preferably be used the same number of groups 12 of cards as there are players. In other words, if there are four players, four groups 12 of cards (sixteen cards total) will be used, and the rest of the cards will be put aside. The cards to be used in the game are then shuffled and dealt in a clockwise manner until all of the cards are dealt. Thus, each player eventually will have four cards.

The dealer controls the play of the game. Each time the dealer commands "pass," everyone passes one card, e.g., to his or her left, and simultaneously receives a card, e.g., from his or her right. Therefore, each player will always have four cards in his hand. When someone has four cards in his hand that are the same, i.e., when he has all cards in a given group 12, he snatches a grab item 14 from the center of the playing surface. This is the signal for everyone else to try to grab one of the grab items 14 as well. Because there is one less grab item than the number of players present, however, one player will not be able to grab a grab item. The player who does not have a grab item when the grabbing is completed is assigned a letter of the word "PIG" and is required to put on and wear one of the pig appendages 16, 20, and then 22. The grab items are all put back in the center of the table, the cards are then reshuffled and redealt, and play continues as described above.

To make the game more exciting, a player may pretend he has four like cards and fake snatching a grab item as long as he does not touch one. If any of the other players is fooled and touches a grab item as a result of the fake, then the first one to be fooled and touch a grab item receives a letter and puts on a corresponding pig appendage piece.

Once a player has received all of the letters and the corresponding pig appendage pieces, the final "penalty" to be assigned is the dot on the "I," which signifies that the player is out of the game. When a player "PIGs" out, one group 12 of cards preferably is removed from the deck and a grab item 14 is removed from the center of the playing surface. Play again continues as described above. This procedure is continued until there are only two players left. At that point, the player with the fewest letters or pig appendages on his body is the winner.

In another embodiment of the present invention, the appendages 16, 20, and 22 are other animal appendages. For example, a cow's, elephant's, cat's or a rabbit's nose and ears are used as the appendages 16, 20, and 22 respectively. In accordance with the present invention, appendages identifiable with any animal can be used as appendages 16, 20, and 22. In yet another embodiment of the present invention, the appendages can be non-animal parts worn on the head such as for example, a clown's hair, nose, ear's, etc. In still another embodiment of the present invention, the groups 12 of playing cards depict different fruits, colors, numbers, shapes, flowers, clowns or other non-animal pictures.

Other variations of this game will occur to those having skill in the art and are deemed to be within the scope of the following claims.

What is claimed is:

1. A method of playing a game by a number of players, the method comprising the steps:

a) placing a number of hand-grabbable grab items in a location where they can be reached by all of the players, the number of grab items being one less than the number of players playing the game;

b) upon the occurrence of a predetermined event, each of the players trying to grab one of the grab items with all but one of the players actually grabbing a grab item;

c) assigning a penalty to the player unable to grab a grab item, the penalty comprising requiring the player unable to grab a grab item to put on and wear a wearable item; and d) repeating steps a) through c) until one of the players has been assigned a predetermined number of penalties and is wearing a predetermined number of wearable items, at which point the player with the predetermined number of penalties is eliminated from the game and the number of players is reduced by one.

2. The method of claim 1, further comprising e) reducing the number of grab items by one when the player with the predetermined number of penalties is eliminated from the game; and f) repeating steps a) through d) with the reduced number players and the reduced number of grab items.

3. The method of claim 2, further comprising repeating steps a) through f) until two players remain, at which point the one of said two players remaining having the lesser number of penalties is declared the winner of the game.

4. The method of claim 1, wherein the game is played with a deck of game cards.

5. The method of claim 4, wherein each of the game cards in the deck bears indicia on one side, the deck comprising a plurality of groups of game cards wherein each of the cards in a given group of game cards bears the same indicia, the indicia on the game cards in the different groups of game cards being different, and wherein the predetermined event comprises one of the players having all of the game cards in a given group of game cards.

6. The method of claim 5, wherein the game comprises the players passing game cards among themselves until said one of the players has all of the game cards in a given group of game cards.

7. The method of claim 1, further comprising one of the players faking that the predetermined event has occurred.

8. The method of claim 7, further comprising assigning a penalty to the first of any players who are fooled by said faking and requiring said first player to put on and wear one of the wearable items.

9. The method of claim 1, wherein the wearable items comprise replicas of animal body parts.

10. A method of playing a game by a number of players, the method comprising the steps:

a) placing a number of hand-grabbable grab items in a location where they can be reached by all of the players, the number of grab items being one less than the number of players playing the game;

b) providing a deck of game cards and distributing game cards among the players, each of the game cards in the deck bearing indicia on one side, the deck comprising a plurality of groups of game cards wherein each of the cards in a given group of game cards bears the same indicia, the indicia on the game cards in the different groups of game cards being different;

c) the players passing game cards among themselves until one of the players has all of the game cards in a given group of game cards, at which point said one of the players reaches for one of the grab items;

d) upon said one of the players reaching for one of the grab items, each of the players trying to grab one of the grab items with all but one of the players actually grabbing a grab item;

e) assigning a penalty to the player unable to grab a grab item, the penalty comprising requiring the player to whom the penalty has been assigned to put on and wear a wearable item; and f) repeating steps a) through e) until one of the players has been assigned a predetermined number of penalties and is wearing a predetermined number of wearable items, at which point the player assigned a predetermined number of penalties is eliminated from the game and the number of players is reduced by one.

11. The method of claim 10, further comprising g) reducing the number of grab items by one when the player with the predetermined number of penalties is eliminated from the game; and h) repeating steps a) through f) with the reduced number players and the reduced number of grab items.

12. The method of claim 11, further comprising repeating steps a) through h) until two players remain, at which point the one of said two players remaining having the lesser number of penalties is declared the winner of the game.

13. The method of claim 10, further comprising one of the players faking that he has all of the game cards in a given group of game cards.

14. The method of claim 13, further comprising assigning a penalty to the first of any players who are fooled by said faking.

15. The method of claim 10, wherein said wearable item comprises a replica of an animal body part.

* * * * *